United States Patent [19]

Asselman et al.

[11] 3,955,618

[45] May 11, 1976

[54] HEATING DEVICE

[75] Inventors: George Albert Apolonia Asselman; Josef Wilhelmus Johannes Maria van der Leegte, both of Eindhoven, Netherlands

[73] Assignee: U.S. Philips Corporation, New York, N.Y.

[22] Filed: July 11, 1973

[21] Appl. No.: 378,245

[30] Foreign Application Priority Data

July 19, 1972 Netherlands ..... 7209936

[52] U.S. Cl. ..... 165/105; 13/1; 13/22; 219/399; 219/406; 219/540; 432/91

[51] Int. Cl. ..... F28d 15/00

[58] Field of Search ..... 165/105; 432/91; 219/326, 378, 399, 406, 530, 540; 13/1, 22

[56] References Cited

UNITED STATES PATENTS

| | | | |
|---|---|---|---|
| 1,987,119 | 1/1935 | Long | 165/105 X |
| 2,885,309 | 5/1959 | Brunke | 165/105 X |
| 3,651,240 | 3/1972 | Kirkpatrick | 165/105 X |

*Primary Examiner*—Albert W. Davis, Jr.
*Attorney, Agent, or Firm*—Frank R. Trifari; J. David Dainow

[57] ABSTRACT

A heating device comprising a plurality of heating chambers, each chamber being bounded by the heat-transmission wall of a reservoir in which a heat-transmission wall of a reservoir in which a heat transport medium is present which completes an evaporation/condensation cycle. The reservoirs are connected, via a common reservoir which also contains heat transport medium, to the same common heat source.

5 Claims, 10 Drawing Figures

HEATING DEVICE

BACKGROUND OF THE INVENTION

The invention relates to a heating device, provided with a heating chamber for objects, bounded by at least one heat-transmission wall whose side which is remote from the heating chamber forms part of the boundary of a reservoir in which a heat transport medium is present which completes an evaporation/condensation cycle during operation, involving on the one hand evaporation by taking up heat originating from a heat source and, on the other hand, condensation on the heat-transmission wall while giving off heat thereto.

A heating device of the kind set forth is known from German Offenlegungsschrift 2,131,607 (PHN. 4998). Liquid heat transport medium which evaporates from the wall to which heat is supplied moves in the vapour phase to the heat-transmission wall as a result of the locally prevailing lower vapour pressure due to the slightly lower local temperature. Subsequently, the vapour condenses on the heat-transmission wall while giving off heat thereto, the said heat being given off through the wall to the heating chamber for the benifit of one or more objects to be subjected to heat treatment. The condensate is returned by capillary forces, via a capillary structure, to the wall where heat is supplied and where it is evaporated again. It is alternatively possible that the condensate is returned exclusively by gravity, i.e. without a capillary structure being present.

The major advantage of this kind of heating device is that a fully isothermal heating chamber is obtained in a comparatively simple manner, which is of major practical importance particularly in ovens. The isothermal nature results from the fact that most vapour always condenses at the area on the heat-transmission wall where the lowest vapour pressure prevails. A locally lower temperature, consequently, is immediately compensated for.

If often occurs in practice that a plurality of heating devices which are constructed as an oven, each device comprising only one heating chamber, are simultaneously used at the same operating temperature in a factory hall. An example in this respect is the simultaneous use of a plurality of tunnel ovens where one or more wires which are covered with a layer of lacquer are fed through each oven in a continuous process in order to bake the lacquer on the wire. Each oven then has its own heat source such as a burner, an electric heating wire, a high-frequency induction coil or similar.

SUMMARY OF THE INVENTION

The invention has for its object to provide a structurally simple multi-chamber heating device which can completely take over the combined task of the separately arranged heating devices and which is cheaper than the independent heating devices together. So as to realize this object, the heating device according to the invention is characterized in that when use is made of a plurality of heating chambers, the relevant reservoirs are connected, via a common reservoir which also contains heat transport medium, to the same common heat source at the area of a common reservoir evaporation wall. An attractive multi-heating chamber device is thus obtained, comprising one central heat source for all chambers instead of an individual heat source for each chamber.

In a preferred embodiment of the heating device according to the invention, the reservoirs are at least partly situated inside the common reservoir and are separated from the common reservoir by heat-transmission reservoir walls. An evaporation/condensation process takes place in the common rerservoir as well as in the reservoirs. In the common reservoir heat transport medium transports heat from the common heat source to the heat-transmission reservoir walls; in the reservoirs the heat which is taken up by the heat transport medium from the heat-transmission reservoir walls is transported to the heat-transmission wall. The manufacture of such a heating device is simple; the reservoirs can be inserted in openings in the wall of the common reservoir, after which they are sealed with respect to the common reservoir.

A further preferred embodiment of the heating device according to the invention is characterized in that the reservoirs and the common reservoir are in open communication with each other. This offers a further structural simplification. There is now only one evaporation/condensation cycle, while temperature gradients and heat losses which occur in the case of partitions which have a thermal resistance are prevented.

In a further preferred embodiment yet of the heating device according to the invention, the common reservoir accommodates a capillary structure which connects the common reservoir evaporation wall to the reservoirs for the return of heat transport medium condensate from the reservoir to the common reservoir evaporation wall. This renders the position of the heating device independent with respect to the common reservoir.

Another preferred embodiment of the device according to the invention is characterized in that the common heat source is arranged inside the common reservoir at the area of the common reservoir evaporation wall. It is thus achieved that the common heat source cannot be damaged, while the construction of the heating device is also more compact.

Some embodiments of the heating device according to the invention will be described hereinafter, by way of example, with reference to the diagrammatic drawing which is not to scale.

DESCRIPTION OF THE PREFERRED EMBODIMENT

Figure 1A:
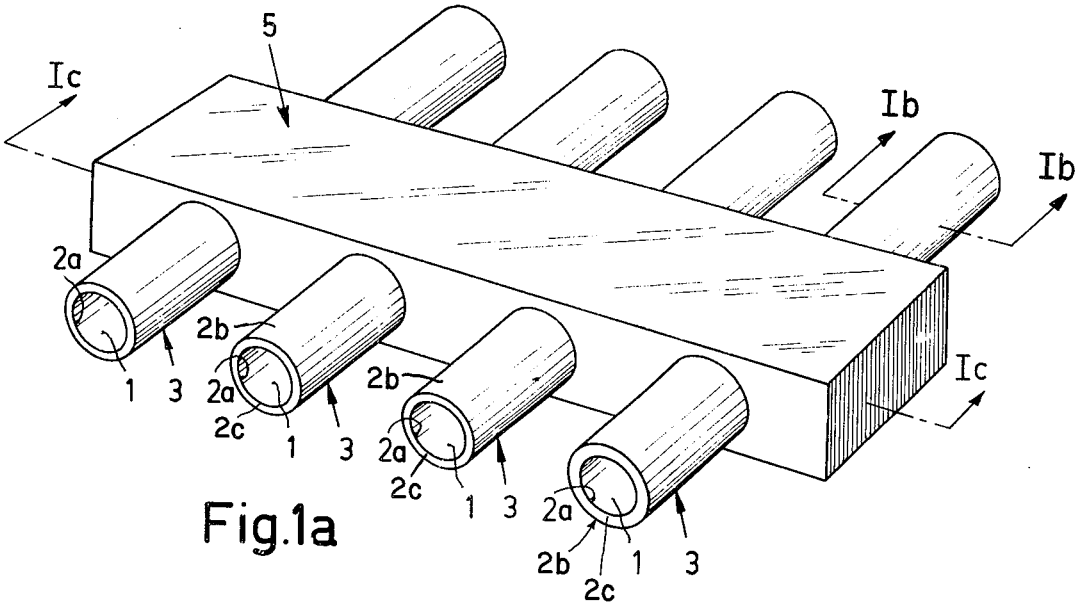
FIG. 1*a* is a perspective view of a heating device of the new invention comprising four heating chambers.
Figure 1B:
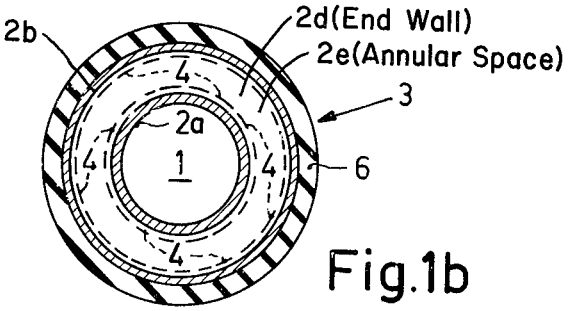
FIG. 1*b* is a view of a reservoir taken along line 1*b*—1*b* of FIG. l*a*.
Figure 1C:
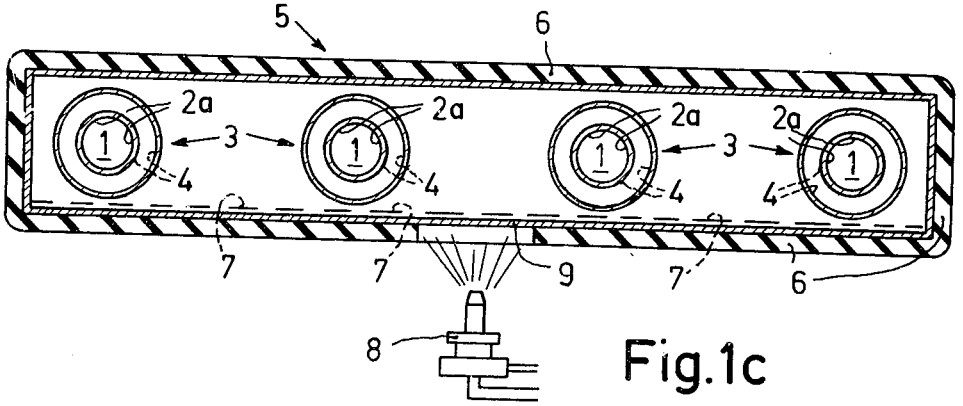
FIG. 1*c* is a cross-sectionsl view of the oven taken along line 1*c*—1*c* of FIG. 1*a*.
Figure 2A:
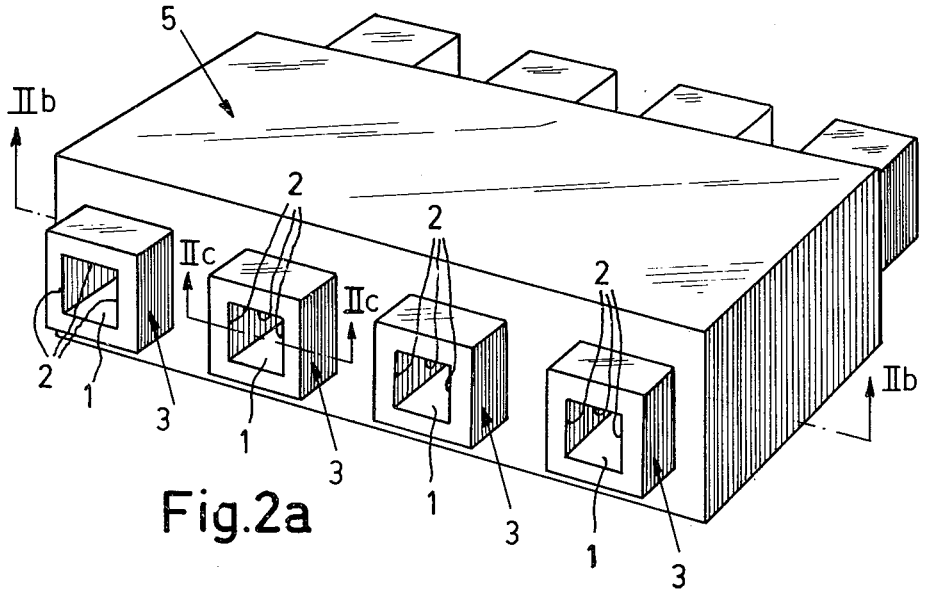
FIG. 2*a* is a perspective view of a second embodiment of the heating device of this invention, comprising four heating chambers each having rectangular cross-section.
Figure 2B:
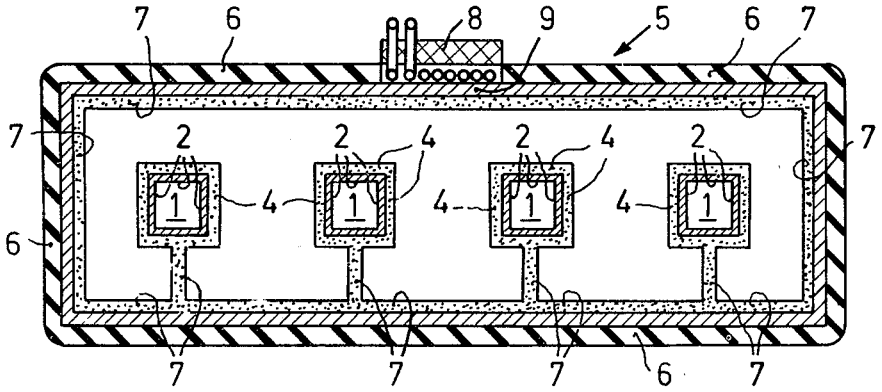
FIG. 2*b* is a sectional view taken along line 2*b*—2*b* of FIG. 2*a*.
Figure 2C:
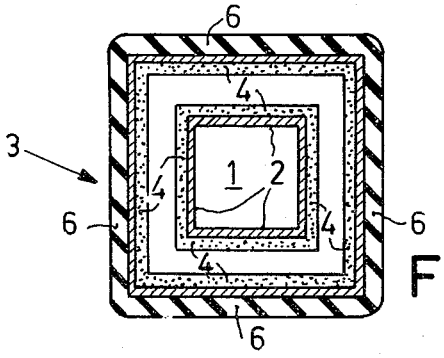
FIG. 2*c* is a sectional view of a reservoir taken along line 2*c*—2*c* of FIG. 2*a*.
Figure 3A:
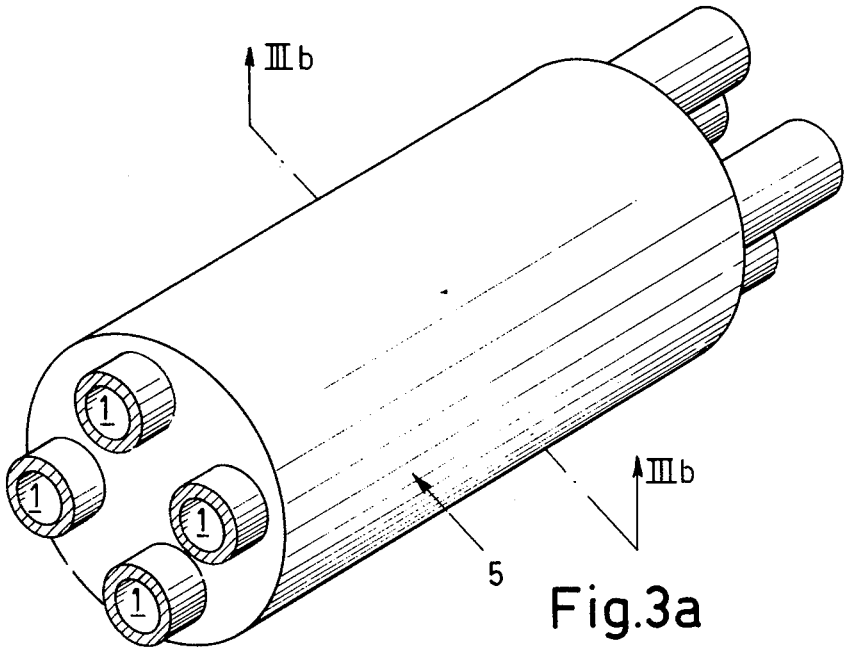
FIG. 3*a* is a perspective view of a third embodiment of an oven of this invention comprising heating chambers having a circular cross-section surrounded by a circularly constructed common reservoir.
Figure 3B:
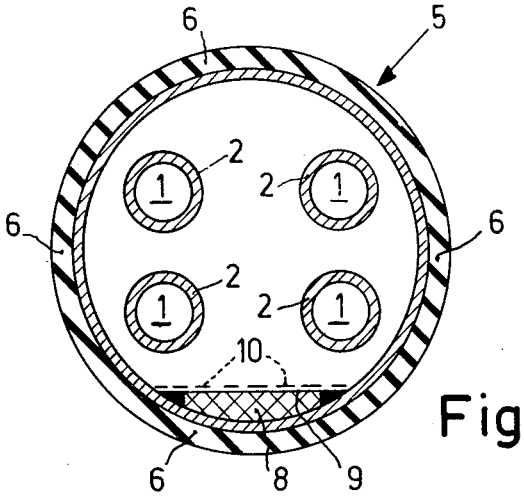
FIG. 3*b* is a sectional view of the oven taken along line 3*b*—3*b* of FIG. 3*a*.

The FIGS. 1 to 3 show heating devices, each comprising four heating chambers, which are constructed as tunnel ovens. In the oven shown in FIG. 1, the heating chambers are bounded by double-walled cylindrical reservoirs which are passed through a common reservoir which is provided with a common heat source.

In FIG. 1*a* of a continuous oven, there are four heating chambers which are denoted by the reference numeral 1. Each heating chamber 1 is bounded by an inner heat-transmission wall 2*a* and an outer heat-transmission wall 2*b*, and end walls 2*c* of a reservoir 3 containing sodium as the heat transport medium in annular space 2*d* between said walls 2*a*, 2*b*, and 2*c*. As appears from FIG. 1*b*, the inner surface of walls 2*a*, 2*b*, and 2*c* of reservoir 3 are covered with a capillary structure 4. FIG. 1*a* furthermore shows a common reservoir 5 which also contains sodium as the heat transport medium. The reservoirs 3 are passed through common reservoir 5. The reservoir walls which separate the reservoirs from the common reservoir are heat-transmitting.

In FIG. 1*c* the outer walls of the oven are covered with a heat-insulating layer 6. The bottom of common reservoir 5 is covered with a capillary structure 7. Heat is supplied to the oven by means of a burner 8, via a common reservoir evaporation wall 9.

The operation of the oven is as follows. Due to the supply of heat to common reservoir 5, liquid sodium which is present in capillary structure 7 evaporates. Sodium vapor subsequently condenses on the parts of the outer walls 2*b* of reservoir 3 which are situated inside the common reservoir, while giving off heat thereto. Due to gravity, the sodium condensate is returned to the capillary structure 7 again. The sodium condensate is fed by capillary forces through this capillary structure to common reservoir evaporation wall 9 where burner 8 supplies heat to the common reservoir. The returned condensate is then evaporated again.

The sodium in the reservoirs 3 as in reservoir 5 completes an evaporation/condensation cycle Due to the taking up of heat from the common reservoir 5, thus operating heat pipes 3 and sodium evaporates in reservoir 3 and condenses on heat-transmission wall 2*a* while giving off heat thereto. The given off heat is given off to heating chamber 1 via the heat-transmission wall 2*a*. Sodium condensate is returned from heat-transmission wall 2*a* to the heat-transmission outer wall parts to be of the reservoirs via the capillary structure 4. A simple isothermal multi-chamber oven is thus obtained, in which all chambers are centrally controlled by a single heat source.

The oven shown in FIG. 2 comprises heating chambers having a rectangular section. The reservoirs are now in open communication with the common reservoir which comprises the common heat source. In the tunnel oven shown in FIG. 2, FIG. 2*a* being an exterior view, the parts corresponding to parts of the oven shown in FIG. 1 are provided with the same references. Reservoirs 3 are in open communication with common reservoir 5, as appears from FIG. 2*b*. The capillary structure 7 inside the common reservoir 5 now covers the entire inner wall of this reservoir and communicates on the lower side with the capillary structure 4 on the heat-transmission walls 2 of the reservoirs 3. An electric heating element, mounted on the common reservoir 5, is now provided as the heat source 8. Liquid sodium again evaporates from the common reservoir evaporation wall 9 and now condenses directly on the heat-transmission walls 2 of the reservoirs 3 while giving off heat thereto. Via capillary structures 4 and 7, sodium condensate is returned to common reservoir evaporation wall 9 where it is evaporated again by common heat source 8.

FIG. 3 shows an oven comprising heating chambers having a circular cross-section, surrounded by the cylindrically constructed common reservoir within which the common heat source is arranged.

In FIG. 3 of a tunnel oven only the common reservoir evaporation wall 9 is provided with a capillary structure 10 which now ensures that the said wall is uniformly moistened. Sodium condensate is returned from the heat-transmission walls 2 to the common reservoir evaporation wall 9 by gravity. The construction is very compact and rectangular chambers 1.

Figure 4A:
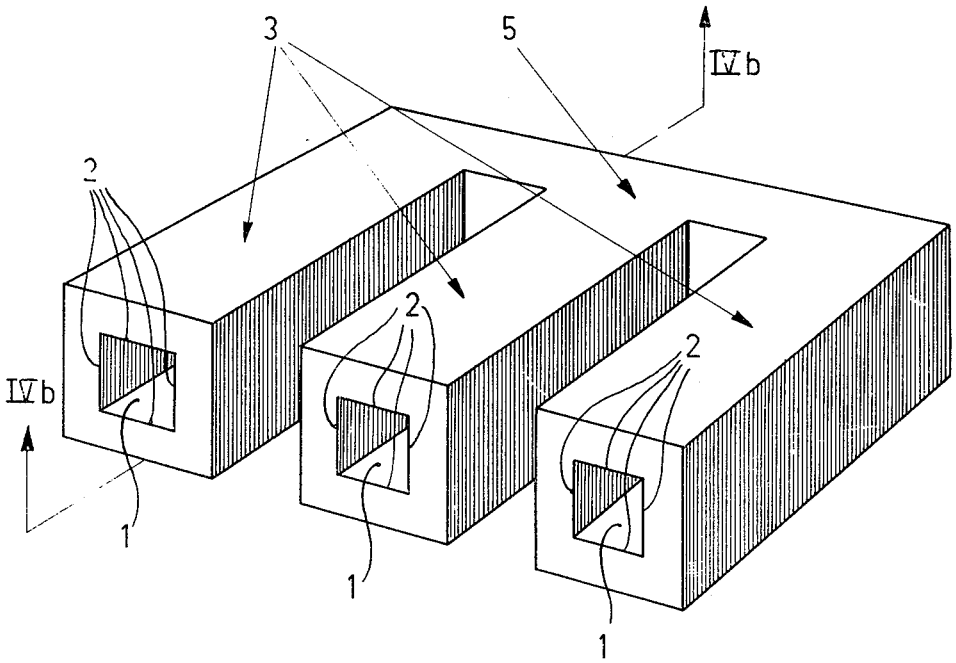
FIG. 4*a* is a perspective view of a fourth embodiment of an oven of this invention comprising three heating chambers.
Figure 4B:
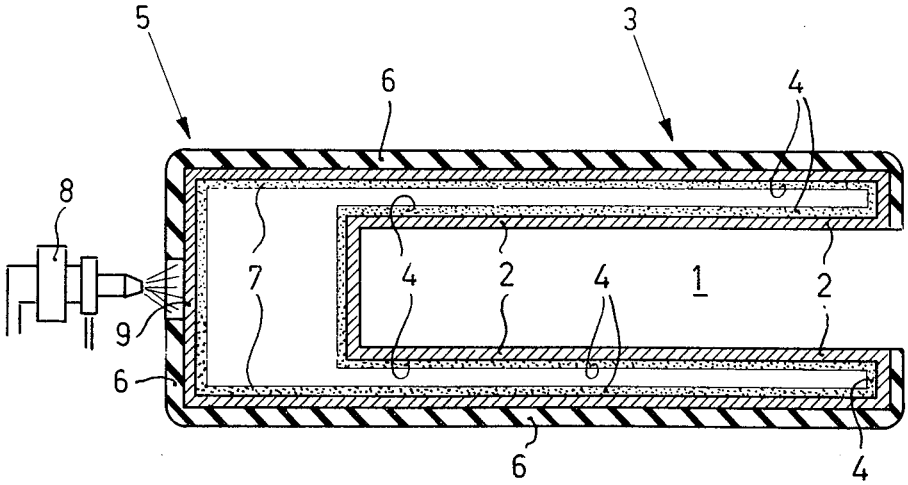
FIG. 4*b* is a sectional view taken along line 4*b*—4*b* of FIG. 4*a*.

FIG. 4 shows an oven comprising three heating chambers which are accessible on only one side and which are bounded by double-walled reservoirs of reactangular cross-section which open into the common reservoir. The oven of FIG. 4, comprises three heating chambers 1. The rear of the double-walled reservoirs 3 opens into common reservoir 5. In the reservoirs 3 as well in the common reservoir 5 a capillary structure, 4 and 7, respectively, is present, the said structures being interconnected. Common heat source 8 again consists of a burner. Liquid sodium evaporates from common reservoir evaporation wall 9 and condenses directly on the heat-transmission walls 2 again. The return of condensate is effected via capillary structures 4 and 7 successively.

What is claimed is:

1. A heating device for use with a heat source, comprising a first heat pipe formed as a common heat reservoir, having walls, one of which is a bottom wall, with outside and inside surfaces, an outside surface of one wall being exposable to said heat source and the inside surfaces thereof defining a first heating space, first capillary material on the inside surface of at least said bottom wall, a plurality of separate heating chambers traversing said first heating space, each chamber being a heat pipe formed from an outer tube and an inner tube with a closed annular space defined by facing wall surfaces of said tubes and facing ends, and an oven space defined within the inner tube, second capillary material on said facing surfaces, and facing ends, vaporizable and condensable first and second heat transporting medium in said first heating space and in said annular spaces respectively, whereby, when heat is applied to said outside surface of the common reservoir wall, the first heat transporting medium in the first space is vaporized and flows to said heating chambers' outer tubes where it condenses on the outer surfaces of the outer tube walls, with heat transmitted through said outer tube walls to the second heat transporting medium within said annular spaces, which second medium vaporizes and flows to the inner tube wall where it condenses and provides heat which is transmitted through said inner wall to said oven therein.

2. Apparatus according to claim 1 wherein said first and second heat transporting mediums are sodium.

3. Apparatus according to claim 1 wherein said tubular heating chambers extend through and outward of said common heating reservoir with the oven space within each inner tube being exposed.

4. Apparatus according to claim 1 wherein said heating chamber tubes are generally circular in cross-section.

5. Apparatus according to claim 1 wherein said plurality of heating chambers comprise an isothermal multi-chamber oven, since said first vaporized heat transporting medium operates as a single-temperature heat source for all the heating chambers.

* * * * *

UNITED STATES PATENT AND TRADEMARK OFFICE

CERTIFICATE OF CORRECTION

PATENT NO. : 3,955,618

DATED : May 11, 1976

INVENTOR(S) : GEORGE ALBERT APOLONIA ASSELMAN ET AL

It is certified that error appears in the above-identified patent and that said Letters Patent are hereby corrected as shown below.

Col. 4, line 24, delete "rectangular chambers 1" and insert --simple--

Signed and Sealed this

Tenth Day of August 1976

[SEAL]

*Attest:*

RUTH C. MASON
*Attesting Officer*

C. MARSHALL DANN
*Commissioner of Patents and Trademarks*